United States Patent [19]

Culley

[11] Patent Number: 4,949,970

[45] Date of Patent: Aug. 21, 1990

[54] GOLF PRACTICE PUTTING DEVICE

[76] Inventor: John E. Culley, 2260 Autumn Way, Meridian, Id. 83642

[21] Appl. No.: 483,731

[22] Filed: Feb. 23, 1990

[51] Int. Cl.[5] ..... A63B 67/02

[52] U.S. Cl. ..... 273/176 H; 273/178 R; 273/176 J

[58] Field of Search ..... 273/176 F, 176 FA, 176 FB, 273/176 B, 176 H, 176 J, 178 R, 178 A, 178 B, 180

[56] References Cited

U.S. PATENT DOCUMENTS

| | | | |
|---|---|---|---|
| 2,606,028 | 8/1952 | Zion | 273/176 H |
| 2,933,318 | 4/1960 | Boynton | 273/178 R |
| 3,762,718 | 10/1973 | Culley | 273/176 H |
| 3,862,760 | 1/1975 | Davis | 273/176 H |
| 3,870,301 | 3/1975 | Brisendine | 273/176 H |

*Primary Examiner*—George J. Marlo

*Attorney, Agent, or Firm*—Paul F. Horton

[57] ABSTRACT

A golf practice putting device including a rotatable disc; a tray mounted upon the disc, and a mat placeable on the tray and extending onto a support surface to provide a playing surface for practice putts. The disc includes a ball receiving cup having a top opening in registry with apertures in the tray and mat for putting a golf ball therein. The top face of the disc is inclined to provide a variety of inclinations on the tray supported thereon, as the disc is rotated. A handle within the cup facilitates manual rotation of the disc. The tray is preferably provided with a downwardly depending collar which is engageable with a sidewall of the disc cup to provide lateral support between tray and disc. The mat may be provided with a central portion for placement upon the tray and a pair of wing sections resting on the support surface adjacent the tray to provide stability to the device.

10 Claims, 1 Drawing Sheet

GOLF PRACTICE PUTTING DEVICE

BACKGROUND OF THE INVENTION

1. Field of the Invention

This invention relates, in general, to golfing devices, and, more particularly, to putting practice devices provided with varying inclinations of putting surfaces.

2. Description of the Prior Art

For putting practice, where, because of lack of time or for other reasons, it is impractical to go to a golf course, it is highly desirable to have a miniature putting green which may be easily set up, as in the office or home. To obtain a putting surface which allows the ball to break, several devices have been created as typified by U.S. Pat. No. 4,018,436, issued to J. U. Leigh; U.S. Pat. No. 3,862,760, issued to F. D. Davis; U.S. Pat. No. 4,743,027 issued to L. G. Simjian, and U.S. Pat. No. 3,762,718 issued to the present inventor. Leigh utilizes a series of panels, hinged to a framework and a series of controls to control each panel. The required mechanism renders the device impractical. Davis provides a miniature golf game having, at one end, a support mounted on rollers and, requires a plurality of pre-shaped inserts to provide various putting surfaces. The Davis apparatus is not suitable for home or office play; is not portable; and contemplates use at a miniature golf course. Simjian utilizes lifting rods for changing the contour of the playing surface. The invention disclosed in U.S. Pat. No. 3,762,718 utilizes a rotatable disc with inclined plane to vary the inclination of an overlying mat but provides no side nor end restraint for the ball being putted and requires adhesive or the like for maintaining the mat in a fixed relationship with the underlying cup.

SUMMARY OF THE INVENTION

These, and other problems are overcome by the present invention. The present invention is of light weight; readily portable; includes a minimum of structural elements; and is therefore cost efficient. The present invention includes only three primary structural elements, namely, a rotatable disc; a tray; and a mat. The tray provides a gentle slope; conforms to the underlying inclination of the rotatable disc; and includes side walls and an end wall which both restrict the confines of the playing area as well as providing stability to the device as the mat engages the same. A downwardly extending collar on the tray engages the interior sidewall of a cup formed in the disc to prevent lateral movement of the disc relative to the tray. Inside the disc up are projections which permit convenient manual rotation of the disc. The mat includes two side wing, each of which are place or a support surface adjacent the opposing sides of the tray to further provide stability to the entire device.

Additional objects and advantages will become apparent and a more thorough and comprehensive understanding may be had from the following description taken in conjunction with the accompanying drawings forming a part of this specification.

DESCRIPTION OF THE INVENTION

Figure 1:
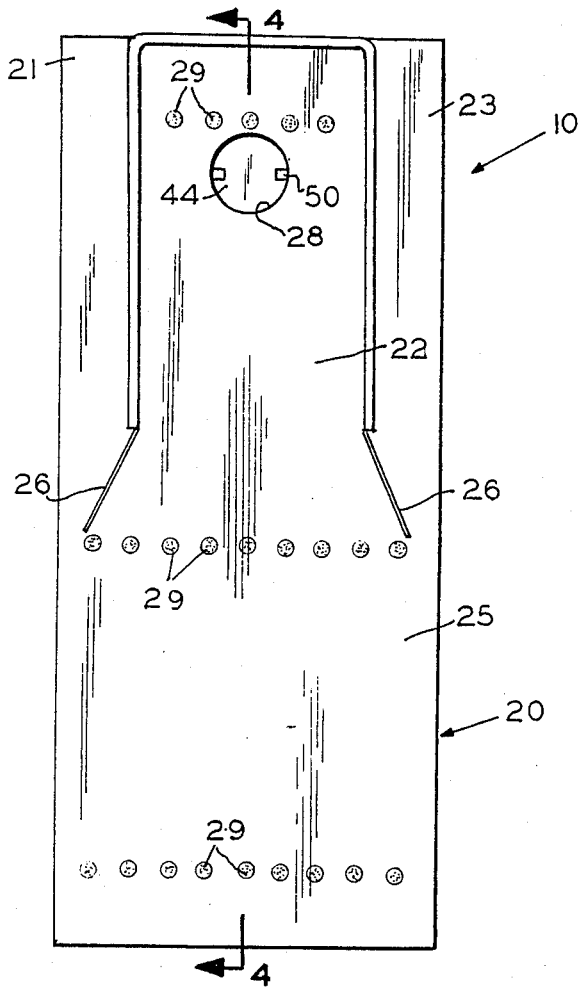
FIG. 1 is a plan view of a practice putting device made according to the present invention.

Referring now to the drawings, an embodiment to be preferred of a golf practice putting device 10 may according to the present invention is disclosed. Device 10 includes, generally, a mat 20, a tray 30, and a disc 40.

Mat 20 may be constructed of any suitable flexible material having sufficient body to lie flat upon a support surface and to effect a smooth transition from the supporting surface onto tray 30. The mat may be of any desired dimensions, being constructed of a rectangular piece of heavy fabric having a width of twenty inches and a length of forty eight inches, in the preferred embodiment. The mat is cut to define a central portion 22 for resting upon the top surface of the tray and a pair of opposing side sections, wings 21 and 23, for resting upon a support surface 3, adjacent the sides of the tray. The length of the central portion is substantially equal to the length of the tray, which is twenty inches in this embodiment. At the juncture of the central portion of the mat and the main portion 25 of the mat, which rests upon support surface 3, such as a floor, the mat is flared by divergent cuts 26 to prevent binding between the tray and the mat and to present a gentle curvature between the central portion and main portion of the mat. The central portion of the mat is provided with an aperture 28 for receiving a golf ball. It is to be noted that the central portion, in being substantially the same size as the bottom of the tray, provides lateral support to the tray in its engagement with the side and end walls. The top surface of the mat may be provided with one or more series of spot marking indicia 29 for alignment during the putting procedure.

Figure 2:
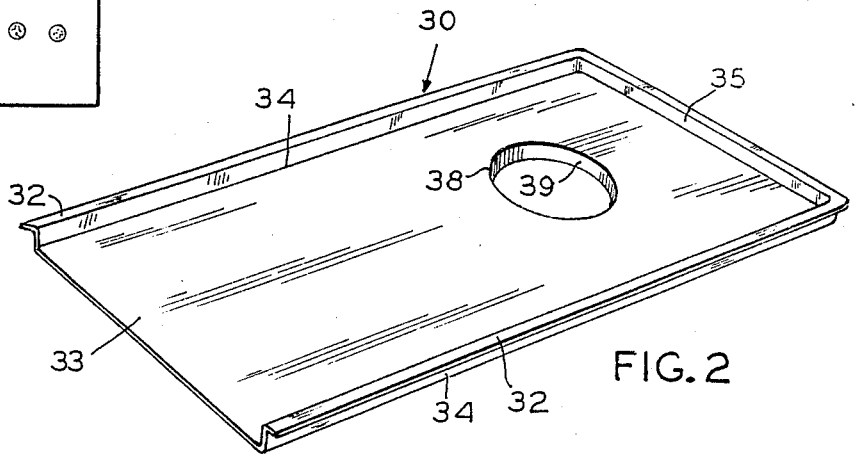
FIG. 2 is a perspective view of the tray of the present invention.
Figure 4:
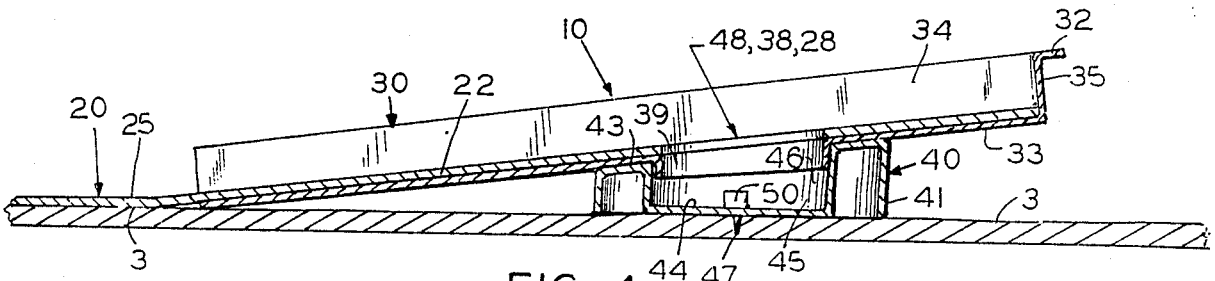
FIG. 4 is a sectional view taken along lines 4—4 of FIG. 1.

Referring now to FIGS. 2 and 4, in particular, tray 30 may be seen to advantage. Tray 30 is constructed of a light weight plastic and includes a bottom member 33, opposing side walls 34 and an end wall 35. Bottom member 33 defines a ball receiving aperture 38 which is in registry with aperture 28 of mat 20 when central portion 22 of the mat is in place, seated on the top surface of bottom member 33 of the tray. For engagement with disc 40, as will hereinafter be explained, the tray is provided with a downwardly depending annular collar 39, surrounding aperture 38. For added strength, the sidewalls and the end wall may be provided with an outwardly and laterally extending lip 32.

Figure 3:
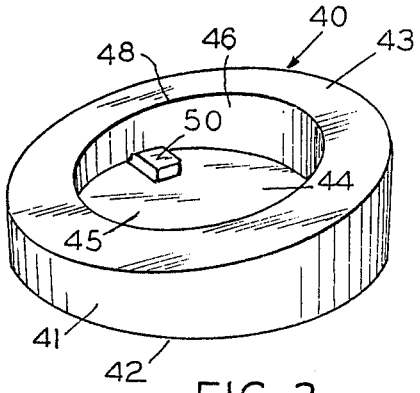
FIG. 3 is a perspective view of the disc of the present invention.

Disc 40, as shown to advantage in FIGS. 3 and 4, is preferably constructed of molded plastic and includes an outer wall 41 having a planar base 42; a top face 43 which is also planar and inclined at a set angle relative to base 42; and a cup 45 having a bottom wall 44, sidewall 46, and a top opening 48 for reception of a golf ball. Top opening 48 is in registry with aperture 38 of the tray and aperture 28 of the mat to provide unimpeded entry for the golf ball into cup 45. To aid in rotation of the disc, a pivot member comprising a pin 47 is mounted on the bottom wall 44 of cup 45 to extend vertically downward at the axial center of the disc. Also, for convenient rotation of the disc from above the playing surface, the interior surface of cup 45 is provided with handle means 50, preferably comprising a pair of projections, only one of which is shown, extending into the cup from bottom wall 44 and sidewall 46 of the cup.

To set up golf practice putting device 10 for operation, disc 40 is first placed upon support surface 3 with pivot pin 47 of the disc engaging the support surface.

Tray 30 is then placed upon the disc with the bottom planar surface of bottom member 33 of the tray engaging the top inclined face 43 of the disc and with collar 39 of the tray fitted into cup 45 of the disc. In this manner, disc 40 may be rotated relative to the tray with collar 39 of the tray restricting lateral movement of the disc as the collar engages the sidewall 46 of the disc cup. The mat is then placed on the support surface 3 with the main portion 25 of the mat lying flat upon the support surface and with central portion 22 resting upon bottom member 33 of the tray, with aperture 28 of the mat in alignment with aperture 38 of the tray and opening 48 of the cup, and with side sections 21 and 23 of the mat extending adjacent and parallel with the sides of the tray on support surface 3. The device is then ready for play.

The golf ball then may be placed at any position on the main portion 25 of the mat and marking indicia 29 used, if desired, for aligning the putt with the cup. Disc 40 may be conveniently rotated by simply reaching into the cup, grasping handle projections 50 and rotating the disc to give a desired break to the putting surface. Rotation of the disc operates to tilt the tray in accordance with the inclined face of the supporting disc. Flexibility of the mat provides a gentle curvature between the main portion 25 of the mat and central portion 22 of the mat. The end wall 35 and sidewalls 34 cf the tray provide a constrained playing surface to prevent the ball from rolling off the playing surface and under furniture and the like because of a faulty putt. It is also to be noted that the side sections of the mat, in cooperation with the integral central portion, provide stability to the entire device. The device is readily disassembled and may be stored in a box, making the device easily portable.

Having thus described in detail a preferred embodiment of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A golf practice putting device comprising:

a tray having a bottom member; a pair of opposing sidewalls; and an end wall, said bottom member provided with a ball receiving aperture;

a rotatable disc having a top face of fixed angular inclination for supporting said tray at a selected angle of inclination, said disc provided with a ball receiving cup having a top opening in registry with said ball receiving aperture of said tray; and a flexible mat placeable upon a support surface for said device and upon the bottom member of said tray to provide a putting surface; said mat provided with an aperture in registry with said aperture of said tray for conducting a golf ball therethrough into the cup of said disc.

2. The device as described in claim 1 wherein said bottom member of said tray is provided with a downwardly depending collar surrounding said ball receiving aperture of said tray and wherein said cup of said disc includes a sidewall and a bottom wall, said tray collar engageable with the side wall of said cup to provide lateral support between said disc and said tray upon rotation of said disc.

3. The device as described in claim 1 wherein said disc includes pivot means engageable with a support surface to facilitate rotation of said disc upon said support surface.

4. The device as described in claim 1 wherein said disc includes within said ball receiving cup, handle means for manual rotation of said disc through respective apertures of said mat and tray.

5. The device as described in claim 1 wherein said mat is provided with an elongated central portion for placement upon the top surface of said bottom member of said tray and wherein said mat is further provided with a pair of parallel and opposing elongated side sections for placement on a support surface adjacent said tray to provide support for the device.

6. A golf practice putting device comprising:

a tray having a bottom member; a pair of opposing sidewalls; and an end wall, said bottom member provided with a ball receiving aperture and a downwardly depending collar surrounding said aperture;

a rotatable disc having a top face of fixed angular inclination for supporting said tray at a selected angle of inclination, said disc provided with a ball receiving cup having a top opening in registry with said ball receiving aperture of said tray; said cup including a sidewall and a bottom wall, said collar of said tray engageable with the side wall of said cup to provide lateral support between said disc and said tray upon rotation of said disc; and said cup provided with handle means for manual rotation of said disc; and a flexible mat placeable upon a support surface for said device and upon the bottom member of said tray to provide a smooth putting surface; said mat provided with an aperture in registry with said aperture of said tray for conducting a golf ball therethrough into the cup of said disc.

7. The device as described in claim 6 wherein said disc includes pivot means engageable with a support surface to facilitate rotation of said disc.

8. A golf practice putting device comprising:

a tray having a bottom member; a pair of opposing sidewalls; and an end wall, said bottom member provided with a ball receiving aperture and a downwardly depending collar surrounding said aperture;

a rotatable disc having a top face of fixed angular inclination for supporting said tray at a selected angle of inclination, said disc provided with a ball receiving cup having a top opening in registry with said ball receiving aperture of said tray; said cup including a sidewall and a bottom wall, and said collar of said tray engageable with the side wall of said cup to provide lateral support between said disc and said tray upon rotation of said disc; and a flexible mat placeable upon a support surface for said device and upon the bottom member of said tray to provide a smooth putting surface; said mat provided with an aperture in registry with said aperture of said tray for conducting a golf ball therethrough into the cup of said disc; and said mat including an elongated central portion for placement upon the top surface of said bottom member of said tray and with a pair of parallel and opposing elongated side sections for placement on a support surface adjacent said tray to provide support for the device.

9. The device as described in claim 8 wherein said disc includes within said ball receiving cup, handle means for manual rotation of said disc.

10. The device as described in claim 8 wherein said disc includes pivot means engageable with a support surface for rotation of said disc.

* * * * *